United States Patent [19]

Buckmaster

[11] 4,432,673

[45] Feb. 21, 1984

[54] MINE ROOF SUPPORT

[75] Inventor: Adrian C. Buckmaster, Upton-on-Severn, England

[73] Assignee: Dowty Mining Equipment Limited, England

[21] Appl. No.: 370,091

[22] Filed: Apr. 20, 1982

[30] Foreign Application Priority Data

Apr. 25, 1981 [GB] United Kingdom ..... 8112825

[51] Int. Cl.[3] ..... E21D 23/16

[52] U.S. Cl. ..... 405/302; 405/298; 405/291

[58] Field of Search ..... 405/291–298, 405/300, 301; 91/170 MP; 299/31, 32

[56] References Cited

U.S. PATENT DOCUMENTS

| | | | |
|---|---|---|---|
| 3,548,601 | 12/1970 | McLuckie | 405/296 |
| 3,728,863 | 4/1973 | Hidasi | 405/294 |
| 3,837,170 | 9/1974 | Martinko et al. | 405/295 |
| 3,903,703 | 9/1975 | Lubojatsky | 405/295 |
| 3,911,686 | 10/1975 | Becker et al. | 405/296 |
| 4,010,618 | 3/1977 | Walker et al. | 405/296 X |
| 4,041,714 | 8/1977 | Allen | 405/296 X |
| 4,306,822 | 12/1981 | Weirich et al. | 405/294 |

FOREIGN PATENT DOCUMENTS

| | | | |
|---|---|---|---|
| 1092412 | 11/1960 | Fed. Rep. of Germany | 405/298 |
| 1054651 | 1/1967 | United Kingdom . | |
| 1470436 | 4/1977 | United Kingdom . | |
| 1494284 | 12/1977 | United Kingdom . | |
| 1513491 | 6/1978 | United Kingdom . | |
| 1516637 | 7/1978 | United Kingdom . | |
| 2045325 | 10/1980 | United Kingdom . | |

*Primary Examiner*—Dennis L. Taylor

*Attorney, Agent, or Firm*—Hayes, Davis & Soloway

[57] ABSTRACT

A method of mining a mineral in which a roof is supported by a plurality of mine roof supports of the kind specified, each advanceable by a force applied to a lower part thereof. During advance of the support an upper part thereof can be sufficiently retarded, by hydraulic jacks carried, by each of its adjacent supports, with respect to the advance of its lower part. This causes the support effectively to rotate and to raise the leading end of the lower part away from the ground on which it is advancing.

7 Claims, 3 Drawing Figures

MINE ROOF SUPPORT

Figure 1:
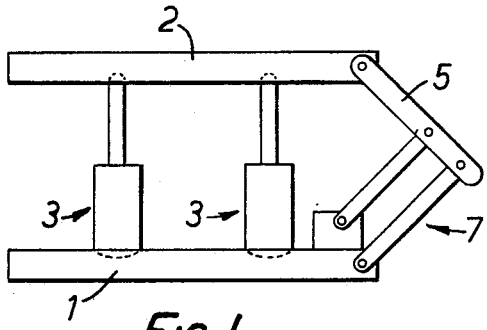

This invention relates to mine roof supports of the kind having (a) a floor-engaging member, (b) a roof-engageable member, (c) a hydraulic prop or props by which the height of the roof-engageable member can be adjusted with respect to the floor-engaging member, and (d) linkage means connecting the floor-engaging member and the roof-engageable member so that, in use, no substantial bending loads are transmitted to the hydraulic prop or props.

Such a mine roof support is hereinafter referred to as "a mine roof support of the kind specified".

Mine roof supports of the kind specified are arranged side-by-side, along a mineral face being cut, with the roof-engageable members urged against the mine roof, to support the roof in the region of that face. As the face is being cut, each mine roof support is released from its engagement with the roof, is caused to advance towards the newly-exposed face by the application of a force to its floor-engaging member, say, by a hydraulically-operated ram, and when in its new position is caused to engage the roof to support the roof.

One species of mine roof support of the kind specified, commonly referred to as a shield support, has linkage means formed by a shield member hingedly connected to the roof-engageable member or canopy and hingedly connected to the floor-engaging member. For the purpose of closing the gap between the canopy of one shield support and the canopy of the shield support next to it, each of the shield supports has a side flap or side shield which, by means of a hydraulic ram or hydraulic rams, can be urged away from the canopy so as to engage the canopy or a similar side shield of an adjacent shield support. Such a side shield, during advance of a shield support, only lightly engages the canopy or side shield of an adjacent shield support, so as not to interfere with the advance.

There are some occasions when a shield support deviates from its intended direction of advance. In order to re-align such a shield support, a higher pressure has been applied to the side shield of that shield support or of the adjacent shield support which engages the advancing roof support in order to steer the advancing shield support along its intended direction of advance. During the time that the higher pressure is applied there has been no retardation of the advance of the roof support.

A mine roof support of the kind specified, for example a shield support, tends to be heavy and has applied to its heavy loads. As a consequence, particularly if a part of the floor, over which the floor-engaging member slides during the advance of a mine roof support, is soft, the leading end of the floor-engaging member may penetrate into the ground and interfere with the advance of the mine roof support. Furthermore, if the floor is uneven, for example stepped, the leading end of the floor-engaging member may not be able to climb over the step.

Mine roof supports of the kind specified, for example a shield support, have been constructed in various ways in an attempt to overcome the problem of the leading end of the floor-engaging member penetrating into a soft floor. Each construction has had its shortcomings.

It is an object of this invention to provide an improved mine roof support of the kind specified.

This invention provides:

A. A method of mining material in which a roof is supported by a plurality of mine roof supports of the kind specified, each being advanceable by a force applied to a lower part thereof, and in which, during advance of a support, an upper part thereof can be sufficiently retarded, by each of its adjacent supports, with respect to the advance of its lower part, to cause the support effectively to rotate and to raise the leading end of the lower part away from the ground on which it is advancing.

B. An assembly of mine roof supports of the kind specified, having means for advancing each support by a force applied to the lower part of the support and means for causing the upper part of a support sufficiently to be retarded, by each of its adjacent supports, with respect to the advance of its lower part, to cause the support, when advancing, effectively to rotate and to raise the forward portion of the lower part away from the ground.

A mine roof support of the kind specified having a lower part, and an upper part and means urgeable away from the upper part to contact the upper parts of, or corresponding means of, both its adjacent supports when the roof support is ranged with other roof supports along a mineral face, with such force that, when the roof support is advancing by a force applied to its lower part, the support will be caused effectively to rotate and to raise the forward portion of the lower part away from the ground.

A mine roof support of the kind specified in accordance with the invention may have an abutment member associated with one side of an upper part of the roof support, e.g. the roof-engaging member or canopy, which can be urged by at least one hydraulically-operated piston-and-cylinder device into abutting contact with the roof-engaging member or canopy of an adjacent roof support. Alternatively, a mine roof support of the kind specified in accordance with the invention may have an abutment member associated with one side of an upper part of the roof support, e.g. the roof-engaging member or canopy, and a second abutment member associated with the other side of the roof-engageable member or canopy, each of which can be urged by at least one associated hydraulically-operated piston-and-cylinder device into abutting contact with a similar abutment member of an adjacent roof support or with the roof-engageable member or canopy of an adjacent roof support.

The retarding means may, conveniently, be a valve which, when operated, connects appropriate piston-and-cylinder devices to a source of high pressure to effect retardation of the upper part of an advancing roof support, by effectively "jamming" it between its two adjacent roof supports, with respect to its lower part.

A mine roof support of the kind specified in accordance with the invention may be a shield support and may have a so-called lemniscate linkage between the floor-engaging member and the shield. The abutment member may be the customary side-shield hitherto used to close the gap between the roof-engaging member or canopy of one shield support and the adjacent shield support and, in some cases, when its piston-and-cylinder device(s) is(are) subject to high pressure, used to steer, with litle or no effective retardation, an advancing shield support.

In those installations where the side shields are not only used to close the gap between a shield support and its neighbour but also urged by a higher pressure to steer that support, that higher pressure may also be employed, when necessary, to cause side shields sufficiently to retard the upper part of a roof support, whereby it can effectively rotate.

The retarding means may be under the control of a miner who will watch an advancing roof support, conveniently from the shelter of another and nonadvancing roof support, and will operate the retarding means, on the non-advancing roof support, when it is required to lift the leading end of the advancing roof support.

When the leading end of a roof support has been lifted, it may be necessary to stop the advance of the roof support until the floor has been so treated, for example packed with dirt, that there will be no interference with the movement of the roof support when the retarding means is rendered inoperative and the advance is resumed.

Figure 2:
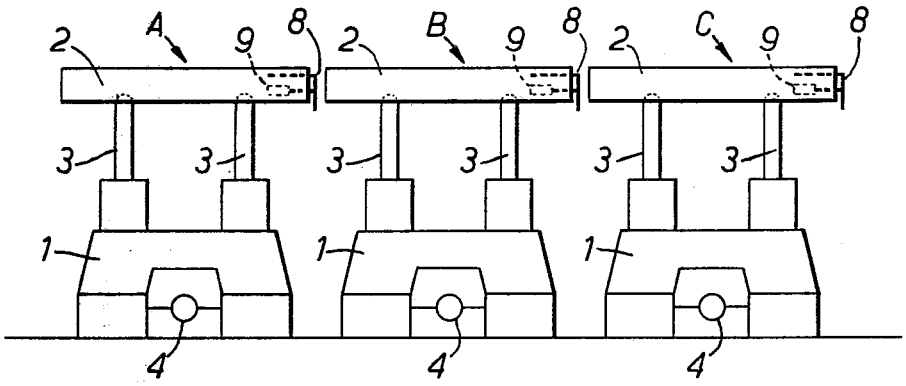
Figure 3:
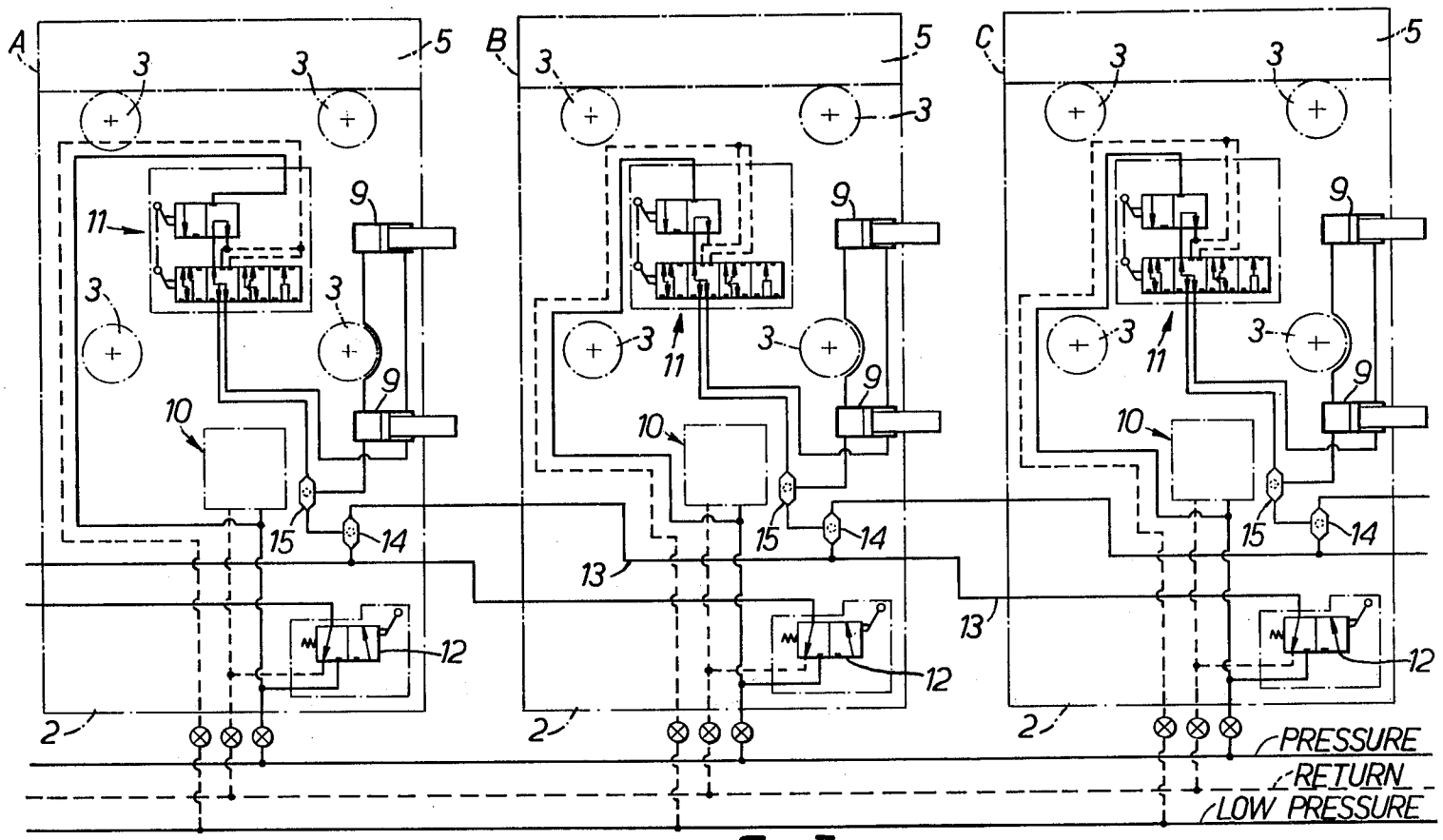

FIG. 1 of the accompanying drawings is a side view of a mine roof support of the kind specified in accordance with one embodiment of the invention, FIG. 2 of the accompanying drawings is a rear view of the three mine roof supports of the kind specified in accordance with an embodiment of the invention (the linkage means being removed), and FIG. 3 of the accompanying drawings shows the relevant parts of the hydraulic circuits of the three mine roof supports shown in FIG. 2.

Referring to FIGS. 1 and 2, each of the mine roof supports A, B and C includes a floor-engaging member 1, a roof-engageable member 2, hydraulic props 3 by which the height of the roof-engageable member 2 can be adjusted with respect to the floor-engaging member 1. A hydraulic advancing jack 4 is carried by the floor-engaging member and, when the roof support is in use in front of a mineral face being cut, the jack 4 will be connected to a suitable abutment, e.g. a conveyor, which removes mineral which has been cut from the mineral face. When the mine roof support is released from its engagement with a roof, the advancing jack can be operated so that a force is applied to the lower part of the mine roof support, thereby to cause advancing movement of the mine roof support.

At the rear of each support is the linkage means formed by a shield 5 and a so-called lemniscate linkage 7.

At one side of each roof-engageable member 2, there is disposed a plate-like member 8 which can be displaced from a position closely-adjacent to the side of the roof-engageable member 2 to a position located away from that side and vice versa. The displacement is under the control of two hydraulically-operated piston-and-cylinder devices 9 (only one of which is visible on each mine roof support in FIG. 2) which are carried by and housed below the upper surface of a roof-engageable member 2.

During the advance of a mine roof support B, with respect to the mine roof support A, which may already have advanced and will be set against a roof, and mine roof support C, which has yet to advance and is set against a roof, movement of the leading end portion of its floor-engaging member 1 may be arrested, say by reason of digging into a soft floor. When a miner under the shelter of a mine roof support, who is observing the advancing operation of mine roof support B, sees that movement of the leading end portion is being arrested, he will, as will be described below with reference to FIG. 2, (i) cause energisation of the hydraulically-operated piston-and-cylinder devices 9 of mine roof support A so that plate 8 extends into firm contact with the roof-engageable member 2 of mine roof support B, and (ii) cause energisation of the hydraulically-operated piston-and-cylinder devices 9 of mine roof support B so that plate 8 extends into firm contact with the roof-engageable member 2 of mine roof support C.

The forces exerted against the said two roof-engageable members will be such that the roof-engageable member 2 of mine roof support B will be sufficiently retarded with respect to its floor-engaging member 1 to cause mine roof support B effectively to rotate and to raise the leading end of its floor-engaging member away from the floor to clear the obstruction.

The miner will cause the hydraulically-operated piston-and-cylinder devices 9 to retract and to free the roof-engageable member 2 of mine roof support B, when the obstruction has been cleared by the leading end.

In the case of shield supports, each plate-like member 8 may be part of the customary side flap or side shield and the hydraulically-operated piston-and-cylinder devices 9 may be the hydraulic rams normally employed to operate a side flap or side shield. In such a case it will be necessary to energise the hydraulic rams with a pressure greater than that previously used (when the plate-like member has only lightly-engaged another roof-engageable member for the sole purpose of closing the gap between one such member and another) in order effectively to jam one roof-engageable member between two adjacent roof-engageable members to effect the necessary retardation of the upper part of a mine roof support.

Referring now to FIG. 3, each mine roof support A, B and C, has the customary and well-known block 10 containing the valves by which the hydraulic props can be caused to extend into contact with a roof to be supported, to contract away from the roof when the support has to be advanced from one roof-supporting position to another, and by which the advancing jack can be operated to cause the mine roof support to advance from the one position to the other.

Each mine roof support A, B and C also has the customary and well-known rotary-selector valve 11 which, in the position shown in FIG. 3, connects each side of the piston of the two hydraulically-operated piston-and-cylinder devices 9 to a source of low pressure. Each piston is of the well-known differential area type and the effect of the low pressure is to cause the plate 8 of a mine roof support lightly to engage the roof-engageable member 2 of an adjacent roof support, thereby to close the gap between the roof-engageable members of two adjacent roof supports.

If the rotary selector valve 11 of a mine roof support is moved into another of its positions, the hydraulically-operated piston-and-cylinder devices 9 of that mine roof support only are connected to a source of higher pressure for the purpose of "steering" or "aligning" the relative positions of that roof support and an adjacent support. This "steering" or "aligning" operation is carried out when the appropriate mine roof supports are not advancing.

If the rotary selector valve 11 of a mine roof support is moved to yet another position the hydraulically-operated piston-and-cylinder devices 9 of that mine roof support can be contracted.

In each of the above-mentioned positions of the rotary selector valve 11, only the hydraulically-operated piston-and-cylinder devices 9 of the mine roof support having that rotary selector valve are energised.

In accordance with the invention, each mine roof support has a "retarding" or "base-lift" valve 12.

The retarding valve 12 of a mine roof support, say support C, can be moved from the position shown in FIG. 3 to another position in which (i) the high pressure supply line is connected by way of line 13 to a shuttle valve 14 and to a shuttle valve 15 of mine roof support B to the hydraulically-operated piston-and-cylinder devices 9 of mine roof support B, and (ii) the high pressure supply line is connected by way of line 13 to a shuttle valve 14 and to a shuttle valve 15 of mine roof support A to the hydraulically-operated piston-and-cylinder devices 9 of mine roof support A.

Thus if a miner, sheltering under mine roof support C and observing the advance of mine roof support B, sees that the leading-end portion of the floor-engaging member of mine roof support B is likely to hit an obstruction or to dig into a floor, he can operate the retarding valve 12 of mine roof support C. This will cause the plates 8 of mine roof support B, which had only been in light contact with, firmly to engage, the roof-engageable member of mine roof support C, and will cause the plates of mine roof support A, which had only been in light contact with, firmly to engage, the roof-engageable member of mine roof support B. The firm engagements are such that the roof-engageble member of mine roof support B is effectively jammed between the roof-engageable members of mine roof supports A and C. This causes the roof-engageable member of mine roof support B sufficiently to be retarded to cause mine roof support B effectively to rotate and raise the leading end of the floor-engaging member of mine roof support B away from the floor.

When, subsequently, the miner restores retarding valve 12 of mine roof support C to the position shown in the drawing, the shuttle valves move so that the high pressure on the devices 9 of mine roof supports A and B will be lost, and the devices 9 will operate as formerly.

In another embodiment of the invention, each mine roof support of the kind specified may have (a) hydraulically-operated piston-and-cylinder device(s) and a plate at one side of its roof-engageable member and may have (b) hydraulically-operated piston-and-cylinder device(s) and another plate at the other side of its roof-engageable member.

The retarding valve of a mine roof support will be arranged to connect the devices on both sides of another support to the source of pressure so that the two plates will move in opposite directions into contact with the plate of two adjacent supports.

I claim:

1. A method of mining in which a mine roof is supported by a side by side assembly of mine roof supports, each having a lower part with a floor-engaging member, an upper part with a roof-engageable member, hydraulic prop means by which the height of the roof-engageable member can be adjusted with respect to the floor-engaging member, means associated with the lower part for advancing the mine roof support, and at least one hydraulically-operable abutment member associated with the roof-engageable member and energisable to move it away from the roof-engageable member, said method including the steps of (a) advancing the mine roof supports, one after the other in a predetermined sequence, from one roof-supporting position to another roof-supporting position, and (b) simultaneously energising said hydraulically-operable abutment member located on one side of the upper part of an advancing mine roof support and said hydraulically-operable abutment member located on the other side of the upper part of that advancing mine roof support, if the advancing movement of the lower part of that mine roof support is being resisted, such that each side of the upper part of the advancing mine roof support is held in such high frictional contact by said abutment members with the upper parts of the non-advancing mine roof supports located on opposite sides of the advancing mine roof support that advancing movement of the upper part is restricted and retarded with respect to the restricted advancing movement of the lower part; whereby, the advancing mine roof support effectively is caused to rotate about its upper part to raise the leading end of the lower part away from the part of the floor over which it is advancing and which is resisting advance of the lower part.

2. A method of mining in which a mine roof is supported by a side by side assembly of mine roof supports, each having a lower part with a floor-engaging member, an upper part with a roof-engageable member, hydraulic prop means by which the height of the roof-engageable member can be adjusted with respect to the floor-engaging member, means associated with the lower part for advancing the mine roof support, and at least one hydraulically-operable abutment member associated with the roof-engageable member and energisable to move it away from the roof-engageable member, said method including the steps of:

(a) advancing the mine roof supports, one after the other in a predetermined sequence, from one roof-supporting position to another roof-supporting position, (b) energising, during advance of a mine roof support, said hydraulically-operable abutment member located on one side of a roof-engageable member so that, by way of the abutment member, the upper part of the advancing mine roof support is in such light frictional contact with the upper part of the non-advancing mine roof support locating on that one side that substantially no resistance to advancing movement of the upper part occurs, (c) simultaneously energising a said hydraulically-operable abutment member located on the other side of the roof-engageable member so that, by way of the abutment member, the upper part of the advancing mine roof support is in such light frictional contact with the upper part of the non-advancing mine roof support located on that other side that substantially no resistance to advancing movement of the upper part occurs, and (d) simultaneously energising both said hydraulically-operated abutment members with a much greater force, if the advancing movement of the lower part of the advancing mine support is being resisted, such that each side of the upper part of the advancing mine roof support is in such high frictional contact by said abutment members with the upper parts of the two non-advancing mine roof supports that advancing movement of the upper part is restricted and retarded with respect to the restricted movement of the lower part; whereby the advancing mine roof support effectively is caused to rotate about its upper part to raise the leading end of the lower part away from the part of the floor over which it is advancing and which is resisting advance of the lower part.

3. A side by side assembly of mine roof supports which, in use, are advanceable one after the other in a predetermined sequence and each of which has (a) a lower part with a floor-engaging member,
(b) an upper part with a roof-engageable member,
(c) hydraulic prop means by which the height of the roof-engageble member can be adjusted with respect to the floor-engaging member,
(d) means associated with the lower part, for advancing the support from one roof-supporting position to another roof-supporting position,
(e) at least one hydraulically-operated piston-and-cylinder device associated with the roof-engageable member,
(f) an abutment member connected to the device(s),
(g) first valve means for connecting the device(s) of the support to a first source of fluid pressure, and
(h) second valve means for connecting the device(s) located on one side of a support and the device(s) located on the other side of that support to a second source of pressure, the second source being at a higher pressure than the first source, whereby the upper part of a support, when it is advancing, can be retarded with respect to its lower part, by way of abutment means, by each of its adjacent supports.

4. An assembly of mine roof supports as claimed in claim 2 in which the first valve means of a support can also connect the device(s) of that support to a third source of pressure, whose presure is higher than that of the first source of pressure.

5. An assembly of mine roof supports as claimed in claim 4 in which the second source of pressure and the third source of pressure are one and the same source.

6. An assembly of mine roof supports as claimed in claim 2 in which the device(s) and abutment member connected thereto of a support are located at one side only of the support.

7. An assembly of mine roof supports as claimed in claim 6 in which the second valve means of one support connects, to the second source of pressure, the device(s) of the support immediately adjacent the said one support and also the device(s) of the support next but one adjacent to the said one support, the support immediately adjacent said one support being between the said one support and the said support next but one adjacent to the said one support.

* * * * *